United States Patent [19]

Wirth et al.

[11] Patent Number: 4,721,074

[45] Date of Patent: Jan. 26, 1988

[54] ENGINE VALVE TRAIN MODULE

[75] Inventors: Rick C. Wirth, Henrietta, N.Y.; Edward L. DeKiep, Grand Rapids, Mich.

[73] Assignee: General Motors Corporation, Detroit, Mich.

[21] Appl. No.: 941,015

[22] Filed: Dec. 12, 1986

[51] Int. Cl.[4] ..... F01L 1/12

[52] U.S. Cl. ..... 123/90.23; 123/90.27; 123/90.31; 123/90.44; 123/DIG. 6

[58] Field of Search ..... 123/90.27, 90.31, 90.44, 123/90.23, 90.22

[56] References Cited

U.S. PATENT DOCUMENTS

| | | | |
|---|---|---|---|
| 2,835,242 | 5/1958 | Jenkins | 123/DIG. 7 |
| 3,306,271 | 2/1967 | Turlay | 123/90.27 |
| 3,540,420 | 11/1970 | Syson | 123/90.31 |
| 4,527,518 | 7/1985 | Osaki et al. | 123/90.23 |
| 4,610,224 | 9/1986 | Fujita | 123/DIG. 7 |
| 4,649,874 | 3/1987 | Sonoda et al. | 123/90.23 |

FOREIGN PATENT DOCUMENTS

| | | | |
|---|---|---|---|
| 35106 | 2/1985 | Japan | 123/90.44 |
| 178911 | 9/1985 | Japan | 123/90.31 |
| 716828 | 10/1954 | United Kingdom | 123/90.23 |
| 920484 | 3/1963 | United Kingdom | 123/90.23 |

*Primary Examiner*—Ira S. Lazarus

*Attorney, Agent, or Firm*—Arthur N. Krein

[57] ABSTRACT

A valve train module used to effect operation of both the intake valve and the exhaust valve for a cylinder of an internal combustion engine includes a housing adapted to be secured to the cylinder head of the engine, the housing supporting a single engine driven camshaft having both intake and exhaust cam lobes thereon. In a preferred embodiment a direct acting hydraulic lash adjuster journaled in the housing is used to effect operation of the intake valve by the intake cam lobe while operation of the exhaust valve is by a rocker arm pivotally supported on a rocker shaft fixed to the housing and by a roller follower reciprocably journaled in the housing so as to operatively interconnect the exhaust cam lobe to one end of the rocker arm, the opposite end of the rocker arm having a hydraulic lash adjuster operatively positioned therein and operatively connected to the exhaust valve.

2 Claims, 2 Drawing Figures

ENGINE VALVE TRAIN MODULE

FIELD OF THE INVENTION

This invention relates to an engine valve train and, in particular to an engine valve train used to effect operation of the intake and exhaust valves for an engine cylinder from a single camshaft.

DESCRIPTION OF THE PRIOR ART

The desirability of effecting the operation of both the intake and exhaust valves for a cylinder of an engine by means of a single camshaft has long been recognized. In addition, the desirability to reduce costs while at the same time improving the reliability of valve train components has also been recognized.

SUMMARY OF THE INVENTION

The present invention relates to a valve train module for a bank of cylinders of an internal combustion engine, the valve train module including a housing adapted to be secured to an associate cylinder head so as to support a rotatable cam shaft carrying both intake and exhaust cam lobes with a direct acting hydraulic lash adjuster operatively positioned in the housing to engage an intake cam lobe for operation of an associate intake valve, and a roller follower operatively positioned in the housing so as to engage the associate exhaust cam lobe to effect pivotal movement of a rocker arm supported by a rocker shaft fixed in the housing, the rocker arm having an integral hydraulic lash adjuster positioned therein to effect operation of an associate exhaust valve.

It is therefore a primary object of this invention to provide an improved engine valve train which is adapted to be assembled as a valve train module that can be tested as a unit prior to its attachment to the cylinder head for a bank of cylinders of an internal combustion engine.

Another object of this invention is to provide an improved valve train for an engine, the valve train being assembled as a module carrying a single camshaft used to effect operation of both intake and exhaust valves for each cylinder in a bank of cylinders.

For a better understanding of the invention as well as other objects and further features thereof, reference is had to the following detailed description of the invention to be read in connection with the accompanying drawings.

DESCRIPTION OF THE PREFERRED EMBODIMENT

Figure 1:
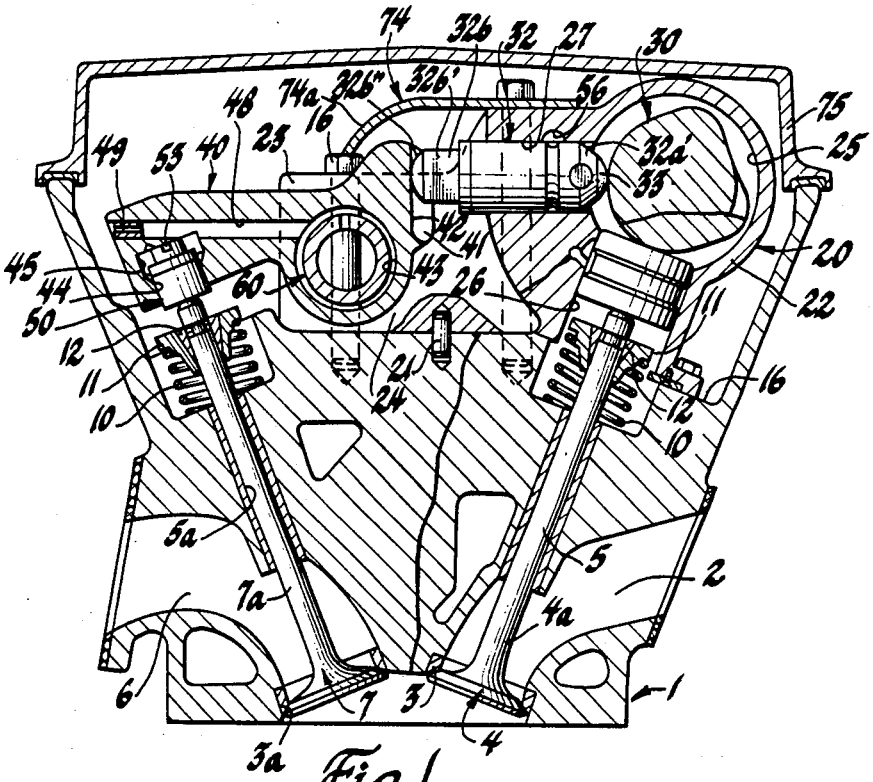
FIG. 1 is a stepped cross-section view of a portion of an internal combustion engine having an engine valve train module in accordance with the invention incorporated therein to effect operation of both the intake and exhaust valves for an engine cylinder, with certain ports shown in elevation; and, FIG. 2 is an enlarged cross-sectional view of the upper valve train module and a portion of the cylinder head of FIG. 1 with elements thereof shown in elevation.

Referring now in particular to FIG. 1, there is shown a portion of an internal combustion engine having an engine block means that includes a cylinder head 1 having an intake passage 2 that terminate at one end in an inlet port encircled by a valve seat 3 with flow therethrough to an associate combustion chamber, not shown, controlled by a first or inlet valve 4, in the form of a poppet valve, that has its stem **4*a* slidably received in a suitable valve stem guide bore 5 provided for this purpose in the cylinder head 1. The cylinder head 1 also includes an exhaust passage 6 having an exhaust port encircled by a valve seat 3*a*, with flow therethrough from an associate combustion chamber, not shown, controlled by a second or exhaust valve 7, also in the form of a poppet valve, that has its stem end 7*a* reciprocally journaled in a suitable valve stem guide bore 5*a* provided for this purpose in the cylinder head 1 in a predetermined longitudinal and transverse spaced apart distance from the valve stem guide bore 5**.

As is conventional, with the intake valve 4 and the exhaust valve 7 are each normally biased to a valve closed position by a valve return spring 10 which abuts at one end against a surface of the cylinder head 1 and at its opposite end abuts against a spring retainer 11 secured in a conventional manner by a keeper key 12 to the associate valve stem **4*a* or 7*a***.

Now as a feature of the subject invention and as a preferred embodiment thereof, there is provided an upper cylinder head member or housing, generally designated 20, that extends longitudinal across the top of the cylinder head 1 and which is secured thereto as by machine screws 14, 15 and 16 that extend through suitable apertures in the housing 20 for threaded engagement in associate internally threaded blind bores provided for this purpose in the cylinder head 1, with transverse and longitudinal alignment being maintained by plural alignment pins 21, only one of which is shown, positioned in suitable blind bores **1*a* and 20*a*** provided in the opposed sides of these elements.

Figure 2:
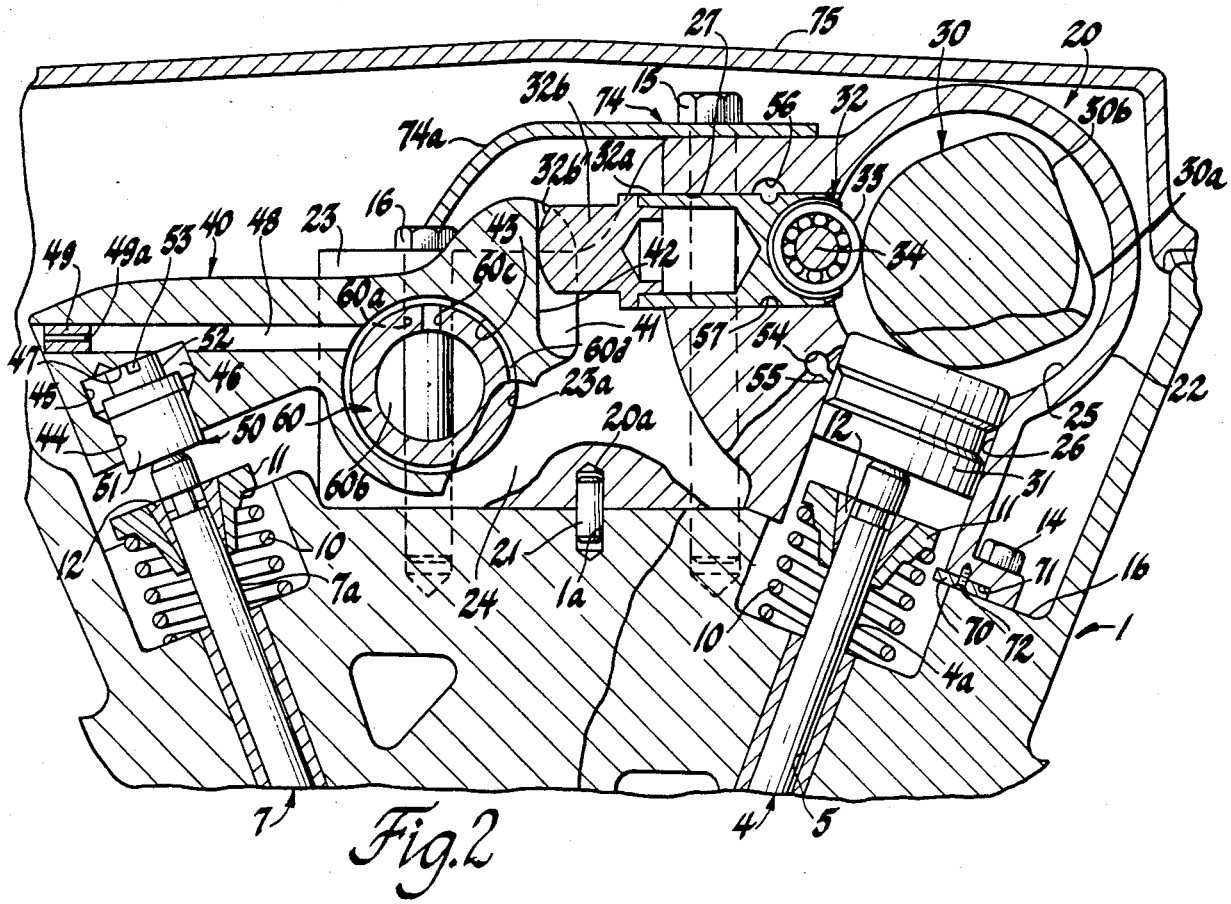

As shown and with reference to the FIGS. 1 and 2, the housing 20 includes an enlarged, longitudinally extending, right hand portion 22, longitudinally spaced apart left hand, rocker shaft support posts 23, one one of which is shown, and corresponding intermediate webs 24 connecting the support posts 23 to the right hand portion 22. In the construction shown, the flat lower surface of the right hand portion 22 is downwardly inclined relative to the flat bottom surfaces of the support post 23 and webs 24 so as to conform to the corresponding machined upper surface **1*b* of the cylinder head 1**.

As shown, the right hand portion 22 of the housing 20 is provided with an enlarged, longitudinally extending bore 25 to receive an engine driven camshaft 30 having adjacent sets of intake and exhaust cam lobes **30*a* and 30*b*, respectively, for each in line combustion chamber, not shown, the camshaft 30** being suitably journaled for rotation at opposite ends thereof, in a manner well known in the art.

Also as shown, the right hand portion 22 of the housing 20 is provided with through guide bores 26 formed substantially concentric with the reciprocating axis of the intake valves 4 so that each such guide bore 26 is adapted to slidably receive the follower body of a suitable, conventional type direct acting hydraulic lash adjuster, generally designated 31, driven by an associate intake cam lobe **30*a*. Although any suitable type direct acting hydraulic lash adjuster 31** may be used, including a roller type hydraulic valve lifter, in the construction shown, the direct acting hydraulic lash adjuster is similar to the type disclosed in U.S. Pat. No. 3,509,858 entitled "Overhead Cam Valve Lifter", issued May 5, 1970 to Scheibe et al, the disclosure of which is incorporated herein by reference thereto. Each such direct acting hydraulic lash adjuster 31 being used to control the opening and closing movement of an associate intake valve 4 for each of the respective cylinders, not shown, of the engine.

In addition, the right hand portion 22 of the housing 20 is provided with through guide bores 27, angularly and longitudinally spaced from the guide bores 26, each to reciprocally receive an associated roller follower; generally designated 32, driven by an associate exhaust cam lobe 30*b*.

In the preferred construction shown, each roller follower 32 is formed with a tubular body 32*a* having a cavity at one end, the right hand end with reference to the Figures to rotatable receive a follower roller 33 rotatably supported by a shaft 34 fixed at opposite ends to the suitably bored opposed side walls of the body 32*a* and with a rocker actuator 32*b* suitably secured, as by welding, to the tubular body 32*a*, so as to form an extension thereof, with the outboard or free end of the rocker actuator 32*b* being provided with external side flat walls 32*b*' of a predetermined extent therebetween and with an arcuate outer edge surface 32*b*'' for engagement with a rocker arm 40.

Each of the support posts 23 is provided with a through bore 23*a* to receive a rocker shaft 60 which is axially retained by the machine screws 16 extending through apertures 60*a* provided in the rocker shaft 60 whereby the rocker shaft is adapted to pivotally support the rocker arms 40. As shown, the rocker shaft 60 is of hollow tubular configuration so as to define a lubricating oil passage 60*b* which is adapted to be supplied with pressurized lubricating oil during engine operation in a manner well known in the art and, accordingly, is not shown. At each rocker arm 40 location, the rocker shaft 60 is provided with a radial extending, riser passage 60*c* to effect flow communication between the oil passage 60*b* and an associate annular groove 60*d* formed in the outer peripheral surface of the rocker shaft 60.

Referring now to the rocker arms 40, each such rocker arm 40 at one end thereof, the right hand end with reference to the figures, is bifurcated so as to define spaced apart arms 41 to slidably receive the two flat side surfaces 32*b*' of the associate roller follower 32 and to define an abutment surface 42 for engagement by the outer edge surface 32*b*'' of this roller follower 32. As should now be apparent, the side flats 32*b* of the roller follower 32 as operatively positioned between the arms 41 of the associate rocker arm 40 serve as an anti-rotation device for the roller follower 32 and also function to effect axial positioning of its associate rocker arm 40 on the rocker shaft 60 at a suitable location intermediate the adjacent pairs of associate support posts 23.

Intermediate its ends, each rocker arm 40 is provided with a transverse bore 43 whereby it is adapted to be pivotally supported by the rocker shaft 60. At its opposite or valve activator end, the left hand end with reference to the drawings, the rocker arm 40 is provided with a stepped blind bore extending upward from its lower surface so as to define a guide bore wall 44, an enlarged bore wall 45 defining the outer limits of an annular hydraulic fluid chamber 46, and an abutment shoulder 47.

Hydraulic fluid, such as lubricating oil, is supplied to the fluid chamber 46 by a passage 48 which at one is in fluid communication with the oil in the annular groove 60*d*, intermediate its ends the passage 48 breaks through a portion of the bore wall 45 and shoulder 47, thus affecting flow communication with the fluid chamber 46 and, at its opposite end this passage 48 is provided with a plug 49, having an orifice passage 49*a* therethrough of a predetermined cross-sectional area for the escape of air, the plug 49 being suitably secured in the passage 48, as by a press fit.

A suitable, conventional hydraulic lash adjuster, generally designated 50, is operatively positioned, secured and guided in the guide bore wall 44. Although the hydraulic lash adjuster 50 may be of any suitable type as desired, in the construction shown, it is of the type disclosed in the above-identified U.S. Pat. No. 3,509,858 whereby its cup-shaped cylinder member 51 is slidably in the guide bore wall 44 so that its closed lower end abuts against the top of the valve stem 7*a* of the exhaust valve 7, while the plunger 52 of the lash adjuster which is slidably supported within the cylinder member 51 for relative axial movement relative thereto has its upper open end engaged against the abutment shoulder 47, with a suitable passage means 53 effecting fluid communication between the hollow plunger 52 and the fluid chamber 46 in a manner well known in the art.

Of course, in the construction illustrated, lubricating oil is also supplied to each of the direct acting hydraulic lash adjusters 31 by a longitudinal oil gallery 54 and by an associate side port 55 and, also preferably to each of the roller followers 32 by an oil gallery 56 and, as shown, the roller follower 32 may be provided with an external annular groove 57 located so as to always be in flow communication with the oil gallery 56.

Now, although not forming functional elements of the subject valve train module, but used merely to maintain unit assembly or proper positioning of certain elements, there is provided a retainer clip 70 for each direct acting hydraulic lash adjuster 31 which is located in a slotted groove 71 formed in the bottom surface of the housing 20 adjacent to an associated bore wall 26 and which is secured, as by a flat headed machine screw 72 threaded into the housing 20. Each retainer clip 70 is thus operatively positioned so as to limit outward axial movement of an associate direct acting hydraulic lash adjuster 31.

In addition, a stamped sheet metal, apertured, longitudinal extending rocker arm positioner 74 is secured as by the machine screws 15 to the top of the housing 20 in position so that the depending curved arm portion 74*a* thereof is located to limit pivotal movement of the associate rocker arms 40 in a clockwise direction with reference to the drawing figures.

The above described elements are primarily used to hold the various described elements in unit assembly in the valve train module during testing of this module; then during shipment of the module to an engine assembly plant if manufactured at an off-site location and then during the assembly of the valve train module to an engine. Once the subject valve train module has been assembled as to the cylinder head 1 of an engine, the rocker arm positioner 74 can be removed, if desired, before the usual valve train cover 75 is secured in a conventional manner to the cylinder head 1 or, as shown, the rocker arm positioner 74 can be left secured to the housing 20 so that it is available to function as described in the event that future servicing or repair of the engine becomes necessary.

It should now be apparent that the subject valve train module in addition to being able to be assembled and tested as a unit assembly, can be shipped as a unit assembly with the machine screws 15 and 16 merely loosely extending through the housing 20 so as to retain the rocker arm positioner 74 and rocker shaft 60 in unit assembly, this module can be picked up as a unit valve train module assembly by either an assembler or by a suitable robot for assembly to the cylinder head 1 of an engine, as shown.

While the invention has been described with reference to the structures disclosed herein, it is not confined to the specific details set forth, since it is apparent that many modifications and changes can be made by those skilled in the art. This application is therefore intended to cover such modifications or changes as may come within the purposes of the improvements or scope of the following claims.

The embodiments of the invention in which an exclusive property or privilege is claimed are defined as follows:

1. In a reciprocating internal combustion engine of the type having an engine block means defining at least one cylinder with a first port and a second port in flow communication therewith, a first valve and a second valve reciprocably located to control flow through the first and second ports, respectively, and normally biased to a port closed position, the improvement comprising a valve train module that includes a housing adapted to be secured by machine screws to the engine block means above the first and second valves; an engine driven camshaft having axial spaced apart first and second cam lobes operatively supported for rotation in said housing; a lifter guide bore in said housing located substantially coaxial with the reciprocating axis of said first valve; a direct acting hydraulic lash adjuster operatively supported in said lifter guide bore with one end thereof engaging said first cam lobe and at its opposite end being operatively connected to said first valve; a follower guide bore in said housing operatively aligned relative to said second cam lobe; a hollow rocker shaft operatively fixed in said housing in parallel spaced apart relationship to said engine driven camshaft; a rocker arm pivotably supported intermediate its ends by said rocker shaft, said rocker arm having a stepped socket therein at one end thereof, the opposite end of said rocker arm having a bifurcated configuration defining a pair of spaced apart flat surfaced arms with an interconnecting abutment surface; a hydraulic lash adjuster operatively positioned in said stepped socket and thus located so as to operatively engage said second valve; a roller follower reciprocably journaled in said follower guide bore with one end thereof operatively engaging said second cam lobe, said roller follower at its opposite end having spaced apart flats slidably received between said flat surfaced arms of said rocker arm and an arcuate outer edge surface engaging said abutment surface of said rocker arm; a first passage means in said housing for supplying fluid to said direct acting hydraulic lash adjuster; and, a second passage means in said rocker shaft and in said rocker arm for supplying fluid to said hydraulic lash adjuster in said rocker arm.

2. In a reciprocating internal combustion engine of the type having an engine block means defining at least one cylinder with a first port and a second port in flow communication therewith, a first valve and a second valve reciprocably located to control flow through the first and second ports, respectively, the first and second valves normally biased to a port closed position, the improvement comprising a valve train module that includes a housing adapted to be secured by machine screws to the engine block means above the first and second valves; an engine driven camshaft having axial spaced apart first and second cam lobes operatively supported for rotation in said housing; a lifter guide bore in said housing located substantially coaxial with the reciprocating axis of said first valve; a direct acting hydraulic lash adjuster operatively supported in said lifter guide bore with one end thereof engaging said first cam lobe and at its opposite end being operatively connected to said first valve; a first passage means in said housing adapted to be operatively connected at one end to a source of hydraulic fluid and intermediate its ends being in flow communication with said hollow rocker shaft operatively fixed in said housing in parallel spaced apart relationship to said engine driven camshaft and having one end thereof adapted to be operatively connected to a source of hydraulic fluid; a rocker arm pivotably supported intermediate its ends by said rocker shaft, said rocker arm having a stepped socket therein at a valve actuator end thereof, the opposite end of said rocker arm having a bifurcated configuration defining a pair of spaced apart flat surfaced arms with an interconnecting abutment surface; a hydraulic lash adjuster operatively positioned in said stepped socket and thus located so as to operatively engage said second valve; a follower guide bore in said housing located between said rocker arm and said camshaft with the axis of said follower guide bore aligned relative to said second cam lobe; a roller follower reciprocably journaled in said follower guide bore with one end thereof operatively engaging said second cam lobe, said roller follower at its opposite end having an actuator arm means defining spaced apart flats slidably received between said flat surfaced arms of said rocker arm and an arcuate outer edge surface engaging said abutment surface of said rocker arm; and, a second passage means in said rocker shaft in flow communication with said hollow rocker arm for supplying hydraulic fluid to said hydraulic lash adjuster in said rocker arm.

* * * * *